US006345898B1

(12) United States Patent
Roach

(10) Patent No.: US 6,345,898 B1
(45) Date of Patent: Feb. 12, 2002

(54) ILLUMINATED PAD LOCK

(75) Inventor: Kenneth Roach, Coral Springs, FL (US)

(73) Assignee: ATICO International USA, Inc

( * ) Notice: Subject to any disclaimer, the term of this patent is extended or adjusted under 35 U.S.C. 154(b) by 0 days.

(21) Appl. No.: 09/730,225

(22) Filed: Dec. 5, 2000

(51) Int. Cl.[7] ..... F21V 33/00

(52) U.S. Cl. ..... 362/23; 362/253; 70/25; 70/432

(58) Field of Search ..... 362/23, 253; 340/542, 340/427, 543; 70/20, 25, 38 B, 52, 286, 432, 435, 437

(56) References Cited

U.S. PATENT DOCUMENTS

| | | | | | |
|---|---|---|---|---|---|
| 317,772 | A | | 5/1885 | Hatch | |
| 922,065 | A | | 5/1909 | Townsend | |
| 1,000,889 | A | | 8/1911 | Bennett | |
| 1,302,896 | A | | 5/1919 | Burgess | |
| 1,526,124 | A | | 2/1925 | Faulkner | |
| 2,566,490 | A | | 9/1951 | Heinz | |
| 3,950,678 | A | * | 4/1976 | Brewer | 340/543 |
| 4,078,248 | A | * | 3/1978 | Hill | 362/100 |
| 4,453,390 | A | * | 6/1984 | Moritz et al. | 70/434 |
| 4,631,940 | A | * | 12/1986 | Krivec et al. | 70/332 |
| 4,819,465 | A | | 4/1989 | Stanich | |
| D306,131 | S | | 2/1990 | Coffman | |
| 5,179,325 | A | * | 1/1993 | Aragon, Jr. | 315/136 |
| 5,404,735 | A | | 4/1995 | Hsieh | |
| 5,522,243 | A | | 6/1996 | Kusmiss | |
| 5,546,776 | A | | 8/1996 | Sun | |
| 5,587,702 | A | | 12/1996 | Chadfield | |
| 5,595,081 | A | * | 1/1997 | Nuzzo | 70/446 |
| 5,664,446 | A | | 9/1997 | Kusmiss | |
| 5,727,405 | A | | 3/1998 | Cromwell | |
| D397,026 | S | | 8/1998 | Drake | |
| 5,832,752 | A | | 11/1998 | Zeller | |
| 6,047,575 | A | | 4/2000 | Larson | |
| D427,884 | S | | 7/2000 | Castellanos | |
| 6,086,223 | A | | 7/2000 | Fogle | |

FOREIGN PATENT DOCUMENTS

| | | | | |
|---|---|---|---|---|
| EP | 1063627 A2 | * | 12/2000 | 340/542 |

* cited by examiner

*Primary Examiner*—Thomas M. Sember
(74) *Attorney, Agent, or Firm*—Cobrin & Gittes

(57) ABSTRACT

An illuminated combination pad lock that illuminates in response to pressing in the combination dial or raising the shackle although still in the locked position. The illumination ceases in response to release of the combination dial or the shackle.

8 Claims, 4 Drawing Sheets

FIG. 3
(PRIOR ART)
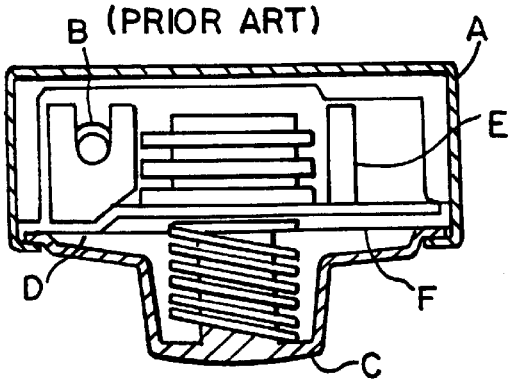
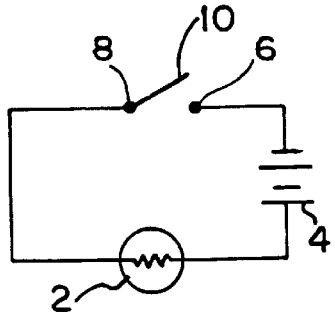
FIG.5
FIG.4
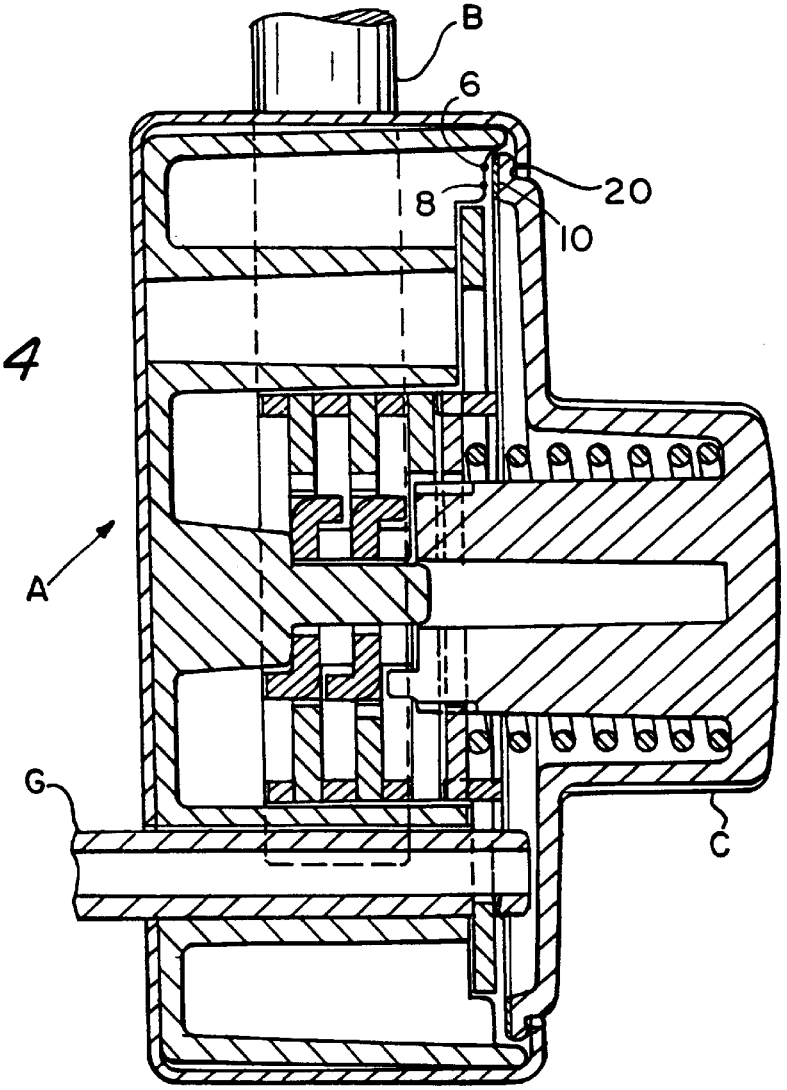

ILLUMINATED PAD LOCK

CROSS-REFERENCE TO RELATED PATENT APPLICATIONS

STATEMENT REGARDING FEDERALLY SPONSORED RESEARCH OR DEVELOPMENT

Not Applicable.

BACKGROUND OF THE INVENTION

1. Field of the Invention

The present invention relates to locks, and more particularly to pad locks and accessories useful in association therewith.

2. Discussion of Related Art

U.S. Pat. No. 6,086,223 (the '223 patent) reveals a Pad lock lighting device. The '223 patent mentions that although many variations of switching means are possible, a simple push button switch may be used on the lock that is pressed to illuminate a dial of a combination pad lock. The '223 patent discusses the need for providing artificial light to enable a user to operate the lock when the light in the surrounding area is inadequate, such as during dark hours. The dial or thumb rollers need to be illuminated, either by natural or artificial light.

The '223 patent also envisions incorporating circuitry into the lock case itself, and with light source and switching means which extend from the case. Present lock manufacturers may simply incorporate the circuitry and power sources into dead space provided by existing lock designs and provide orifices though which a light emitting member (bulb, LED, etc.) and some actuation means may extend. In the case of a front position dial, a tiny light bulb would extend from a single orifice just above the dial reference marker found on most locks. On locks having a series of rotary dials on the bottom of its base, a protruding, elongate lighting panel or ridge would be involved.

What the '223 patent overlooks, however, is that adding the simple push button or other such switching means changes the way in which a user generally operates the combination pad lock, since the user must grope for the push button or other switching means first to actuate before operating the lock. Such adds to the time the user spends to open the combination pad lock. It would be desirable to provide an illuminated padlock that illuminates in response to the user either pushing the combination dial inward of the casing and/or pulling the casing relative to the shackle.

BRIEF SUMMARY OF THE INVENTION

One aspect of the invention resides in a combination dial pad lock that has an electrical circuit for powering a light source. The light source is arranged to shine light on the combination dial by a marker arrow that is on the casing adjacent the dial. The marker arrow signifies the location to which the dial is turned to align a particular number in the combination one at a time. At least a peripheral edge portion of the dial is made of a non-opaque material, such as a clear transparent or translucent plastic. The electrical circuit includes a switch, which is in a normally open state, the light source, power source such as a battery, and necessary electrical connections to complete the circuit when the switch is in its closed state. The switch includes a conductive strip in an inside face of the dial and two spaced apart switch terminals located on the inside of the casing of the pad lock and arranged facing the conductive strip.

In response to pressing the combination dial inwardly against a spring bias of the combination dial, a gap between the two spaced apart terminals is closed by the conductive strip, thereby closing the electrical circuit to enable illumination by the light source. When the combination dial is no longer being pressed inwardly, but permitted instead to return to its biased condition, the metal strip separates from the two spaced apart terminals and the electrical circuit becomes open. As a consequence, the light source is turned off.

Another aspect causes the light to illuminate in response to pulling the casing relative to the shackle.

A further aspect causes the light to illuminate in response to either pulling the casing relative to the shackle or pushing the dial inward relative to the casing.

BRIEF DESCRIPTION OF THE SEVERAL VIEWS OF THE DRAWING

FIG. 3 is a schematic top view of the embodiment of FIG. 1, showing contents of the combination pad lock as is known conventionally;

FIG. 4 is a sectioned side view of the combination pad lock of FIG. 1;

FIG. 5 is a schematic circuit diagram of the lighting circuit used in FIG. 4;

DETAILED DESCRIPTION OF THE INVENTION

Referring to FIGS. 1–4, a single-dial combination padlock made in accordance with the invention essentially comprises a body A, a shackle B, a manually rotatable dial C, a plurality of tumblers D, a floating fence member E and a tumbler shifter assembly F, which may be provided to enable changing or setting the combination to a combination of one's own choice. It may be equipped with a separate key lock compartment that receives a key G (FIG. 4) to bypass using the combination dial to open the lock. FIG. 3 is referred to as prior art, because all that is visible in this figure is known conventionally. However, what is not shown, namely the light source, battery and electrically circuitry, is not conventional.

The inner workings of the combination padlock is known conventionally and need not be repeated here. An example of a conventional teaching is found in U.S. Pat. No. 3,894,415, whose contents are incorporated by reference.

Figure 1:
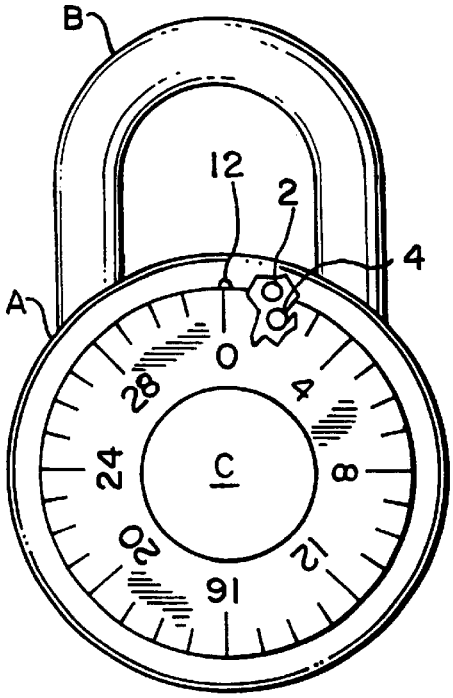
FIG. 1 is a front view of an embodiment of the present invention showing a combination pad lock with a front dial configuration and illumination capability.
Figure 2:
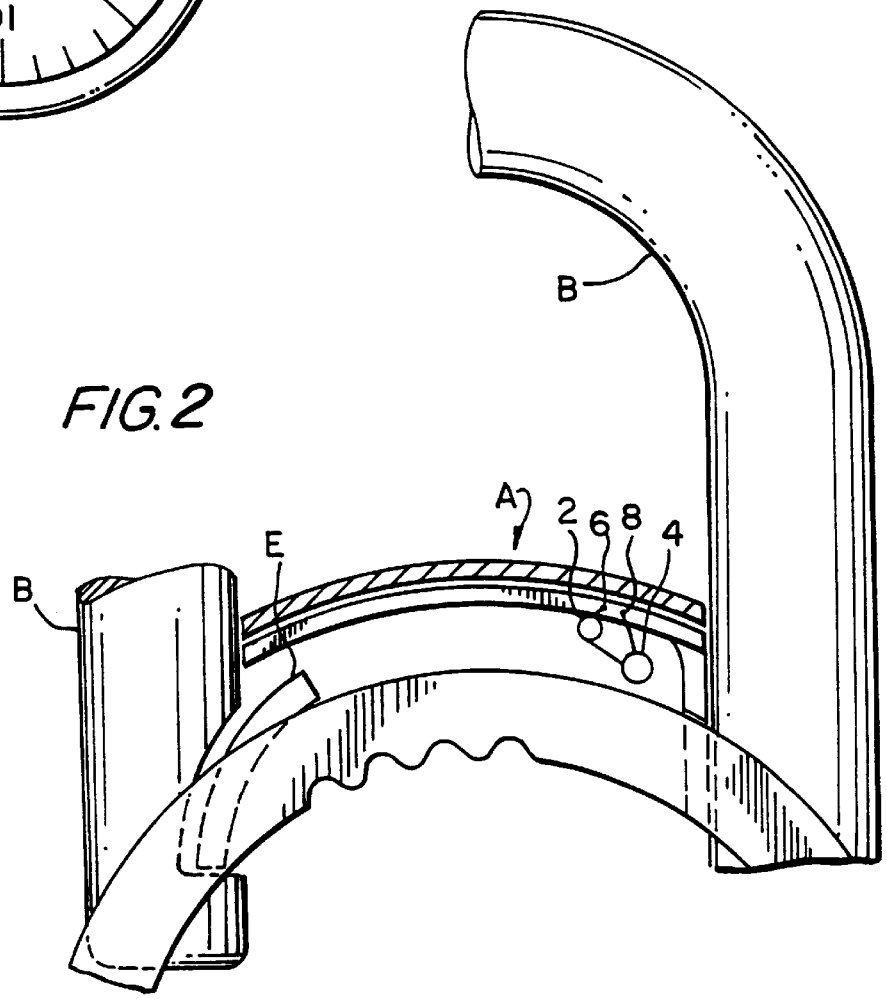
FIG. 2 is an enlarged, partially broken view of the top portion of FIG. 1, showing a portion of the interior.

Referring to FIG. 2, a light source 2, such as a light emitting diode, is arranged to shine its light, when powered by a battery 4, beneath the dial. The light source 2 and battery are electrically connected to each other through an electrical circuit, which includes a switch. The switch includes spaced apart terminals 6, 8 and, as best seen in FIG. 4, a conductive strip 10 that is annular. The electrical circuit is shown schematically in FIG. 5. It makes no difference whether the terminals 6,8 are on the underside of the dial as shown and the strip 10 is on the casing body A beneath the underside of the dial C or the reverse. The reverse would entail the strip being on the underside of the dial C and the spaced apart terminals being on the casing body A beneath the underside of the dial C. The electrical circuit closes by pressing the dial C inwardly against the casing. In so doing, the terminals 6, 8 are bridged or the gap between them closed by the strip 10. As a result, the light source 2 illuminates, shining light in the vicinity of the marker 12 (FIG. 1). The marker 12 signifies the location for alignment with particular numbers that make up the combination when rotating the dial C to align the tumblers D (FIG. 3) into appropriate position for opening the lock. When the dial C is released, the spring bias (FIG. 3) forces the strip 10 and the terminals 6, 8 to separate from each other, thereby opening the circuit and the light source goes off.

Figure 6:
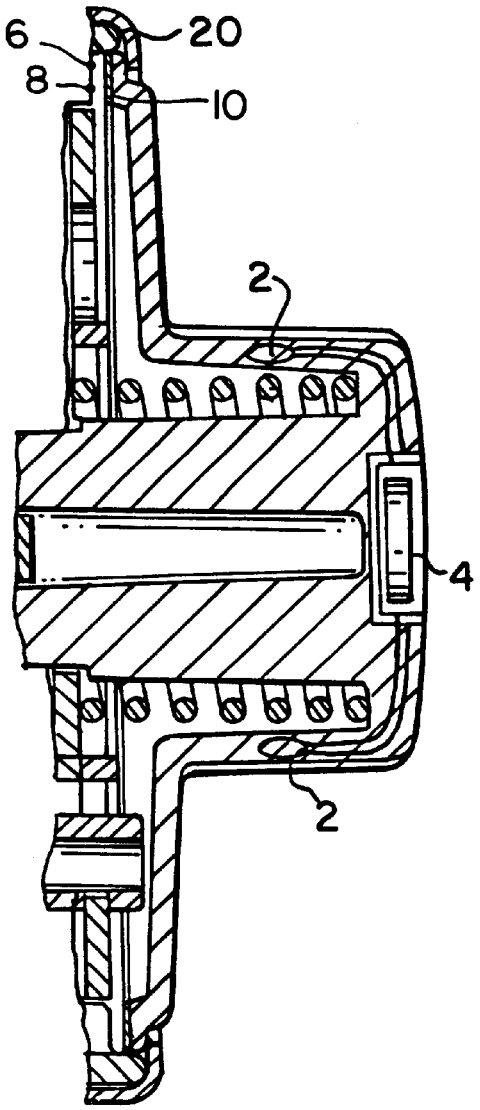
FIG. 6 is a sectioned side view as in FIG. 4 but for a further embodiment.
Figure 7:
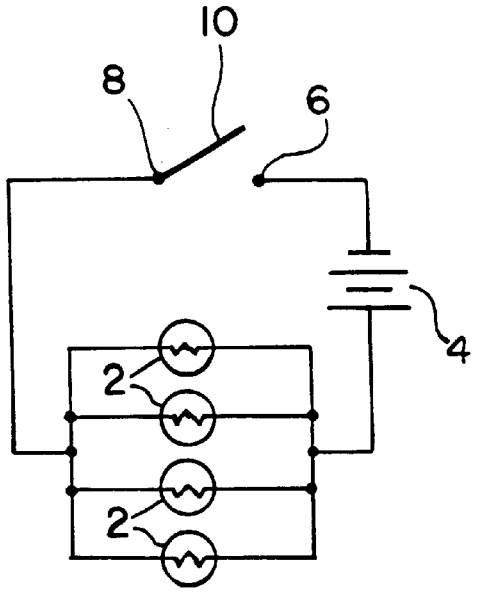
FIG. 7 is a schematic circuit diagram of the lighting circuit used in FIG. 6.

FIGS. 6 and 7 show a further embodiment, in which the light source 2 and battery 4 are in the dial C instead of in the casing body A as was the case for the embodiment of FIGS. 1–5. Further, a plurality of light sources 2, such as four light emitting diodes, are arranged about the radial periphery of the dial knob, preferably evenly spaced from each other. The light sources are arranged preferably in a parallel circuit as shown in FIG. 7. The switch action to either open or close the electrical circuit is the same as in the embodiment of FIGS. 1–5. Since the battery 4 is conveniently located at the front of the knob, a battery door (not shown) may be provided to provide easy access to replace the battery as needed. Although not shown, the knob may have a cover portion (that is either transparent or translucent) that encloses the light sources, but which is removable to provide access to the light sources and thereby enable light source replacement when needed. Note that the light source bulbs would be either recessed from or in contact with the cover portion.

Figure 8:
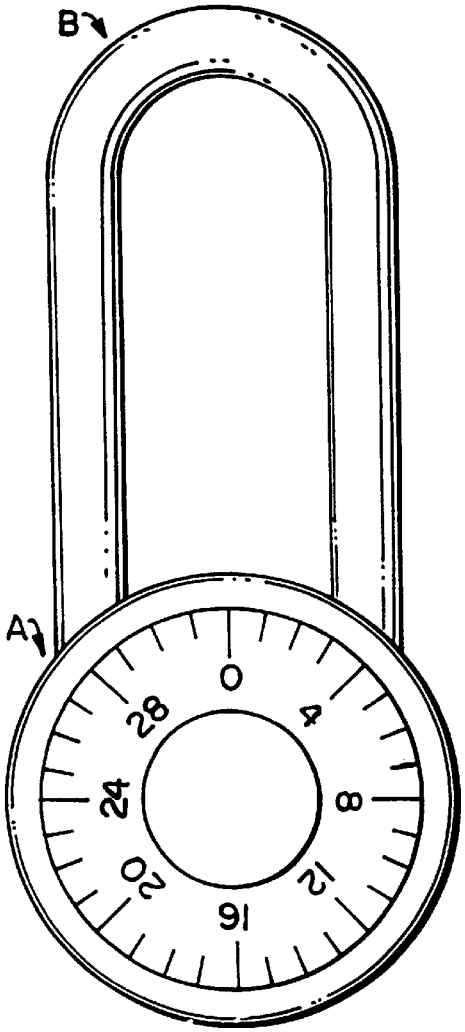
FIG. 8 is a front view as in FIG. 1, but for a further embodiment and showing the shackle in a more raised position.
Figure 9:
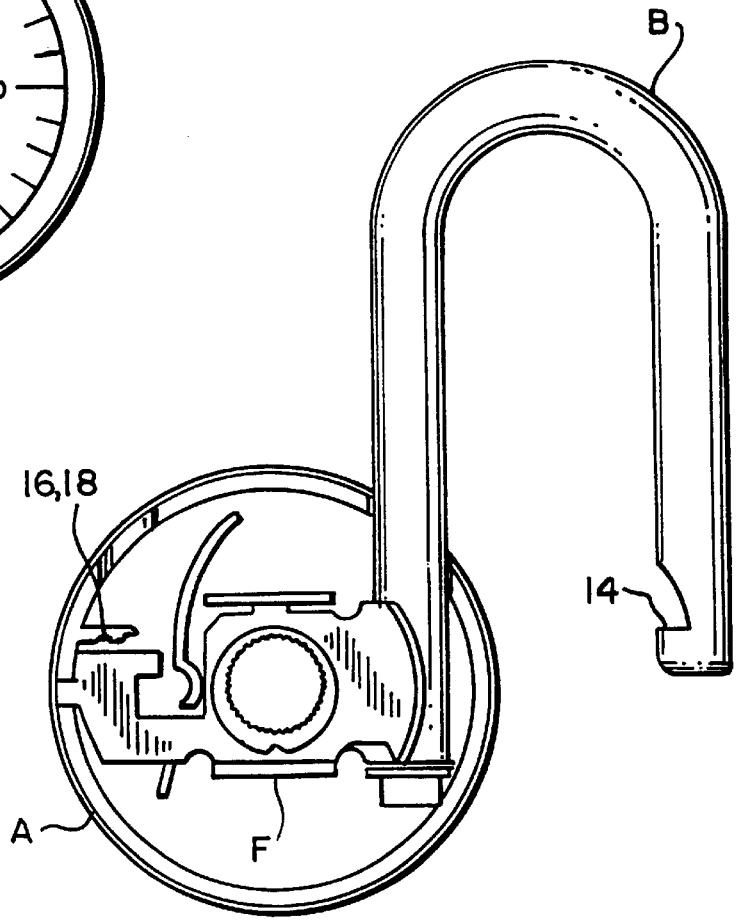
FIG. 9 shows a rear view of the embodiment of FIG. 8, but with the lock in the open position and partially showing the contents inside.

FIGS. 8 and 9 is a further variation in which the switch of the embodiments of FIGS. 1–5 and FIGS. 6 and 7 is replaced by terminals 16, 18 and the flat metallic stop 14 at the end of the shackle B. In the locked position, the shackle may be raised from the position of FIG. 1 to the position of FIG. 8, constituting the amount of play in the shackle B before the flat metallic stop 14 engages. Where the flat metallic stop engages is where the terminals 16, 18 are arranged. Electrical wiring to the battery and light sources is provided in the same manner as shown in the other embodiments.

In the case of FIGS. 4 and 6, it may be preferable to effect electrical contact to open the electrical circuit in response to the peripheral edge of the dial C moving away from the peripheral casing lip 20. After all, the peripheral edge of the dial C is in contact with the peripheral casing lip 20 when the dial is in its spring biased condition. While in such contact, the electrical circuit is open so the power source does not power the light source. However, when the dial C is pushed inwardly so that the peripheral edge of the dial C moves out of contact with the peripheral casing lip 20, the electrical circuit closes, thereby allowing the power source to power the light source. The circuitry may include a three-way switch so that when the switch is closed between two of the three terminals (and in contact between the peripheral edge of the dial C and the peripheral casing lip 20), an electrical circuit loop that includes a resistor and a capacitor but not the light source is powered up. When the switch closes the third terminal instead of the second (when the peripheral edge of the dial C is moved out of contact with the peripheral casing lip 20), an electrical circuit loop that includes the light source is powered by the power source.

Any of the foregoing embodiments may be combined with each other, preferably using a common power source. Thus, a user might move the shackle to initiate illuminating the light and/or press the combination dial inward which would also enable illuminating the light. If the combination dial or the shackle were released (but not both simultaneously), the light would remain lit. If both were released, the light would go out. To effect this, two switches are arranged in parallel in the electrical circuit that includes the power source and the light.

One switch is a shackle switch, associated with the movement of the shackle within its range of play while remaining in the locked position. That is, the casing and the shackle may be pulled in opposite directions, causing more of the shackle to be out of the casing. The other switch is a dial switch, associated with the movement of the dial inwardly of the casing or back toward lips 20 of the casing.

While the foregoing description and drawings represent the preferred embodiments of the present invention, it will be understood that various changes and modifications may be made without departing from the spirit and scope of the present invention.

What is claimed is:

1. An illuminated combination pad lock device, comprising:

a casing and a combination dial that is rotatable about an axis of rotation, the casing having a back, a sidewall extending from a periphery of the back, a lip that extends inwardly from the sidewall spaced from the back, and a contact surface between back and the combination dial, the combination dial being movable in an axial direction between an outward position, which is where the combination dial is against a peripheral underside of the lip of the casing but is clear of the contact surface, and an inward position, which is where the combination dial is clear of engagement with the peripheral underside of the lip of the casing but contacts the contact surface;

a light source secured to one of the casing and the combination dial and directed to shine light to illuminate designations on the combination dial; and electrical circuitry including a switch and a power source, the power source being arranged to power the light source to shine in response to closing of the switch, the switch closing in response to the combination dial entering the inward position and opening in response to the combination dial entering the outward position.

2. A device as in claim 1, wherein the combination dial is constructed of a material selected from a group consisting of translucent plastic and transparent plastic, the light source being arranged to shine light through the material from a location within the casing.

3. A device as in claim 1, wherein the combination dial is constructed of a material selected from a group consisting of translucent plastic and transparent plastic, the light source being arranged to shine light through the material from a location within the combination dial.

4. A device as in claim 2, wherein the casing has a marking that signifies an alignment location with the designations on the combination dial, the light source being arranged to shine light in an area between the marking and a peripheral edge of the combination dial.

5. An illuminated combination pad lock device, comprising:

a casing and a combination dial that is rotatable about an axis of rotation, the casing having a back, a sidewall extending from a periphery of the back, a lip that extends inwardly from the sidewall spaced from the back, a contact surface between back and the combination dial, the combination dial being movable in an axial direction between an outward position, which is where the combination dial is against a peripheral underside of the lip of the casing but is clear of the contact surface, and an inward position, which is where the combination dial is clear of engagement with the peripheral underside of the lip of the casing but contacts the contact surface, the casing also having a shackle arranged to be movable between a locked position and an unlocked position depending upon positions of tumblers in the casing that move in response to the combination dial turning to appropriate positions, the shackle being further movable because of play between two different positions in response to pulling forces even though remaining in the locked position;

a light source secured to one of the casing and the combination dial and directed to shine light to illuminate the designations on the combination dial; and electrical circuitry including a shackle switch, a dial switch and a power source, the power source being arranged to power the light source to shine in response to closing of the shackle switch, the shackle switch closing in response to the shackle being in one of the two different positions and opening in response to the shackle leaving the one of the two different positions, the power source being arranged to power the light source to shine in response to closing of the dial switch, the dial switch closing in response to the combination dial entering the inward position and opening in response to the combination dial entering the outward position, the dial switch and the shackle switch being in parallel with respect to each other in the electrical circuitry.

6. A device as in claim 5, wherein the combination dial is constructed of a material selected from a group consisting of translucent plastic and transparent plastic, the light source being arranged to shine light through the material from a location within the casing.

7. A device as in claim 5, wherein the combination dial is constructed of a material selected from a group consisting of translucent plastic and transparent plastic, the light source being arranged to shine light through the material from a location within the combination dial.

8. A device as in claim 6, wherein the casing has a marking that signifies an alignment location with designations on the combination dial, the light source being arranged to shine light in an area between the marking and a peripheral edge of the combination dial.

* * * * *